US011932978B2

(12) United States Patent
Mandruzzato et al.

(10) Patent No.: US 11,932,978 B2
(45) Date of Patent: Mar. 19, 2024

(54) LINKING MACHINE PROVIDED WITH AN IMPROVED GUIDE FOR ALIGNING TWO FABRIC EDGES TO BE JOINED

(71) Applicant: SANTEX RIMAR GROUP S.R.L., VICENZA (IT)

(72) Inventors: Giulio Mandruzzato, Vicenza (IT); Andrea Nicoletti, Vicenza (IT)

(73) Assignee: SANTEX RIMAR GROUP S.R.L., Trissino (IT)

( * ) Notice: Subject to any disclaimer, the term of this patent is extended or adjusted under 35 U.S.C. 154(b) by 52 days.

(21) Appl. No.: 17/737,634

(22) Filed: May 5, 2022

(65) Prior Publication Data

US 2022/0356621 A1 Nov. 10, 2022

(30) Foreign Application Priority Data

May 6, 2021 (IT) ..... 102021000011552

(51) Int. Cl.
*D05B 7/00* (2006.01)
*D05B 35/10* (2006.01)

(52) U.S. Cl.
CPC ..... *D05B 7/00* (2013.01); *D05B 35/10* (2013.01)

(58) Field of Classification Search
CPC ..... D04B 7/00; D04B 35/10; D04B 35/102; D04B 35/105; D04B 35/107
(Continued)

(56) References Cited

U.S. PATENT DOCUMENTS 2,035,365 A 3/1936 Clayton
4,190,009 A * 2/1980 Matthews ..... D05B 7/00 112/25
(Continued)

FOREIGN PATENT DOCUMENTS

CN 105133207 A 12/2015
CN 206616342 U 11/2017
(Continued)

OTHER PUBLICATIONS

Italian Search Report Application #102021000011552 dated Mar. 11, 2022.
(Continued)

*Primary Examiner* — Danny Worrell
(74) *Attorney, Agent, or Firm* — Polsinelli PC

(57) ABSTRACT

A linking machine (104) comprising a fixed unit comprising a support frame (108), a mobile unit (200) comprising a device for advancing or transporting (116) the fabric along a longitudinal direction (Y-Y), a device for positioning (120) a needle (110) along a transverse direction (X-X), perpendicular to said longitudinal direction (Y-Y) and coplanar with the fabric, an actuator device (124) of said needle (110) in a vertical direction (Z-Z), perpendicular to said longitudinal (Y-Y) and transverse (X-X) directions, for performing the linking. Advantageously, the linking machine (104) comprises a feed guide (20) for two fabrics to be joined, such as a neck (1,10), provided with a separating cotton (3) and a knitted fabric (6), positioned upstream of said needle (110) in the longitudinal direction (Y-Y). The feed guide (20) comprising a first stop (21) suitable to constitute an abutment and a positioning for said separating cotton (3) of the neck (1,10), said first stop (21) being adjustable in position along said transversal direction (X-X) so as to be able to
(Continued)

adjust a distance (a) of the seam line (13) from the inner edge of the neck (5).

13 Claims, 15 Drawing Sheets

(58) Field of Classification Search
USPC ..... 112/475.02, 475.03
See application file for complete search history.

(56) References Cited

U.S. PATENT DOCUMENTS

| | | | | | |
|---|---|---|---|---|---|
| 4,197,802 | A * | 4/1980 | Matthews | D05B 7/00 | 112/27 |
| 4,393,799 | A * | 7/1983 | Matthews | D05B 7/00 | 112/27 |
| 4,846,085 | A * | 7/1989 | Ishibashi | D05B 7/00 | 112/27 |
| 4,856,440 | A * | 8/1989 | Matthews | D05B 7/00 | 112/27 |
| 5,619,940 | A * | 4/1997 | Moriguchi | D05B 7/00 | 112/27 |
| 5,678,501 | A * | 10/1997 | Rosso | D05B 27/185 | 112/27 |
| 5,730,075 | A * | 3/1998 | Moriguchi | D05B 7/00 | 112/27 |
| 6,397,121 | B1 * | 5/2002 | Kawamura | D05B 7/00 | 112/27 |
| 2003/0106345 | A1 * | 6/2003 | Ochi | D05B 7/00 | 66/64 |
| 2017/0283997 | A1 * | 10/2017 | Nocenti | D04B 9/46 | |
| 2022/0356621 | A1 * | 11/2022 | Mandruzzato | D05B 7/00 | |

FOREIGN PATENT DOCUMENTS

| | | | |
|---|---|---|---|
| EP | 3 599 305 | A1 | 2/2020 |
| EP | 3 733 945 | A1 | 11/2020 |
| JP | H06 91073 | A | 4/1994 |
| JP | 2020182837 | A | 11/2020 |

OTHER PUBLICATIONS

Chinese Notification of the First Office Action; dated Aug. 4, 2023, Application # 202210487692.1.

Eurasian Patent Office; Notification of the request for additional materials; dated Mar. 27, 2023; Application # 202291065.

European Search Report; dated May 2, 2022; Application # 22170583.3.

* cited by examiner

FIG.1A - PRIOR ART

LINKING MACHINE PROVIDED WITH AN IMPROVED GUIDE FOR ALIGNING TWO FABRIC EDGES TO BE JOINED

FIELD OF APPLICATION

The present invention relates to a linking machine provided with an improved guide for aligning two fabric edges, such as for example a neck and a sweater, with each other.

Prior Art

As is known, linking is a processing technique used in the textile field which consists in joining together two fabric edges. For example, it is used to join collars, cuffs and sleeves to the rest of the garment, to thus be able to make the finished product.

The joining of the edges is performed by picking stitch by stitch both ends of the fabrics. The joining thread is "linked" between the terminal row of the two edges, thus obtaining the continuity of the stitch. The joining thus made is very flat and actually imperceptible.

The linking operation is a process with major limitations:

- it is slow and expensive; in this regard, it is estimated that it takes more than 70% of a garment's production time;
- the current linking machine is not flexible, in fact when the fabric fineness changes it requires a different setup and therefore a setup time that limits the productivity thereof;
- the linking operator needs great experience and skills to be able to reduce errors to a minimum and acquire a certain speed, skills he/she acquires after several months of practice,
- one of the main problems encountered by those working in this sector is excessive eyestrain due to the ways in which the linking is performed; such strain, if prolonged over time, may lead to a progressive reduction in the operator's vision.

For these reasons, providing a linking machine capable of identifying autonomously where to make the stitches, besides being an advantage in terms of speed, costs and accuracy of execution, improves the working conditions of those who use the machine, making the task less heavy and preventing accidents at the workplace.

FIG. 1 shows a traditional linking machine. It is a circular machine where the operator must insert the stitches at the ends of the two fabrics into the tips. Thereafter, the machine makes the stitching points at the pre-positioned knitted fabrics.

There are also examples in the art of linking machines of the automatic or semi-automatic type which aim to solve at least partially the aforementioned drawbacks of the manual-type machine.

However, these machines are not free from drawbacks that prevent or limit the correct functioning thereof.

For example, the parts or edges to be joined, for example a neck and a sweater, should be correctly presented to the sewing or linking area, i.e. to the needle of the linking machine, in order to join the edges in a manner that is both fast and precise.

If the edges are not presented and aligned correctly with the needle, the linking operation will not be able to take place correctly.

The solutions of the prior art do not allow an automatic alignment of the edges which is precise and constant over time to be carried out, whereby this operation is usually entrusted to the experience and manual skill of the operator.

In this way, however, the speed and efficiency of the linking operation is lost and the repeatability and consistency of the quality of the linking operation are not guaranteed.

DISCLOSURE OF THE INVENTION

The need to solve the drawbacks and limitations mentioned with reference to the prior art is therefore felt.

In particular, the need is felt to provide a guide which helps the operator to present the fabrics, such as for example a knitted fabric 6 and a neck 1,10, correctly aligned to be linked by the machine in a precise, fast and repeatable manner.

The need to overcome the drawbacks and limitations of the solutions of the prior art is met by a linking machine according to claim 1.

DESCRIPTION OF THE DRAWINGS

Further features and advantages of this invention will become clearer from the following description of preferred non-limiting embodiments thereof, in which:

FIG. 1*a* shows a view of a manual linking machine of the traditional type;

Elements or parts of elements in common to the embodiments described below are referred to with the same reference numerals.

DETAILED DESCRIPTION

Figure 1B:
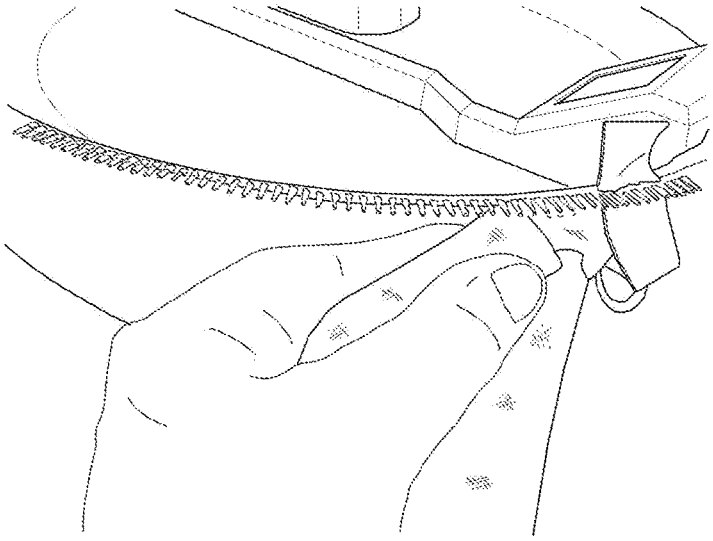
FIG. 1*b* shows a perspective view of a linking machine suitable to use a guide for positioning the edges of fabrics to be joined, according to the present invention.

With reference to the above figures, reference numeral 104 globally indicates an overall schematic view of a linking machine according to the present invention.

The linking machine 104 comprises a fixed unit comprising a support frame 108, a feed device 116 of the fabric along a longitudinal direction or axis Y-Y and a mobile unit 200, supported by said fixed unit or support frame 108, so as to be able to move and appropriately actuate a needle 110 for the joining operation on the fabric.

The mobile unit 200 comprises a positioning device 120 of the needle 110 along a transverse direction or axis X-X, perpendicular to said longitudinal direction or axis Y-Y and coplanar with the fabric, and an actuation device 124 of said needle 110 along a vertical direction or axis Z-Z, perpendicular to said longitudinal Y-Y and transverse X-X directions, to perform the stitching.

The feed device 116 of the fabric comprises blocking means 128 of the fabric, configured to keep the fabric pressed on the feed device 116 of the fabric.

According to a possible embodiment, said blocking means 128 of the fabric comprise an articulated foot 136 with two rotations capable of uniformly pressing the fabric, even in the presence of non-uniform thicknesses of the fabric.

Preferably, said blocking means 128 are adjustable so as to adjust the foot pressure 136 on the fabric itself.

The feed device 116 of the fabric comprises an electric motor 130.

The positioning device 120 of the needle 110 comprises an electric motor 130 connected to a roller screw or recirculating ball screw 201, in turn connected to the mobile unit 200 which performs the linear translation of the needle 110 along the transverse direction X-X.

The actuation device 124 of the needle 110 comprises the electric motor 130 connected to the needle 110 with a connecting rod-crank mechanism for performing the alternate stitching movement of the needle 110.

Preferably, the needle 110 passes through a particular plate with a hole for the needle 110 which limits its deformation and ensures a better stitching.

The fabric is preventively provided with a guide thread inserted into the fabric so as to identify a plurality of segments.

The guide thread is preferably made of a fluorescent material, so as to be easily identified by a suitable optical system or camera 203. To this end, the linking machine 104 is provided with an ultraviolet light lighting system with LEDs 152, to highlight said fluorescent guide thread.

According to an embodiment, said ultraviolet light, lighting system 152 is fitted at the blocking means 128 of the fabric.

Preferably, said guide thread 140 is made of a water-soluble or heat-soluble material, so that it may be dissolved in the subsequent washing of the fabric, without having to proceed with its manual removal.

Advantageously, the linking machine 104 comprises a camera 203 suitable to identify the guide thread. The linking machine 104 is further provided with a control unit 156, operatively connected to the camera 203 and to actuators/electric motor means 130 of the feed device 116 of the fabric, of the positioning device 120 of the needle 110 and of the actuation device 124 of the needle 110.

In this way, the control unit 156 is able to determine in real-time the target position of the needle 110 as a function of the guide thread and to control in real-time the feed devices 116 of the fabric, the positioning devices 120 of the needle 110 and actuation devices 124 of the needle 110 to reach said target stitching position of the needle 110.

In particular, the feed device 116 of the fabric and/or the positioning device 120 of the needle 110 and/or the actuation device 124 of the needle 110 comprise respective electric motors 130 with real-time feedback by means of said control unit 156, depending on the target stitching position of the needle 110.

At least one of the feed device 116 of the fabric, the positioning device 120 of the needle 110 and the actuation device 124 of the needle 110 comprises respective real-time feedback electric motors 130; preferably, at least two of said devices 116, 120, 124 comprise respective real-time feedback electric motors 130 and, even more preferably, all the devices 116, 120, 124 comprise respective real-time feedback electric motors 130.

As mentioned, the linking machine 104 is configured to perform the linking of two separate fabrics.

Figure 3:
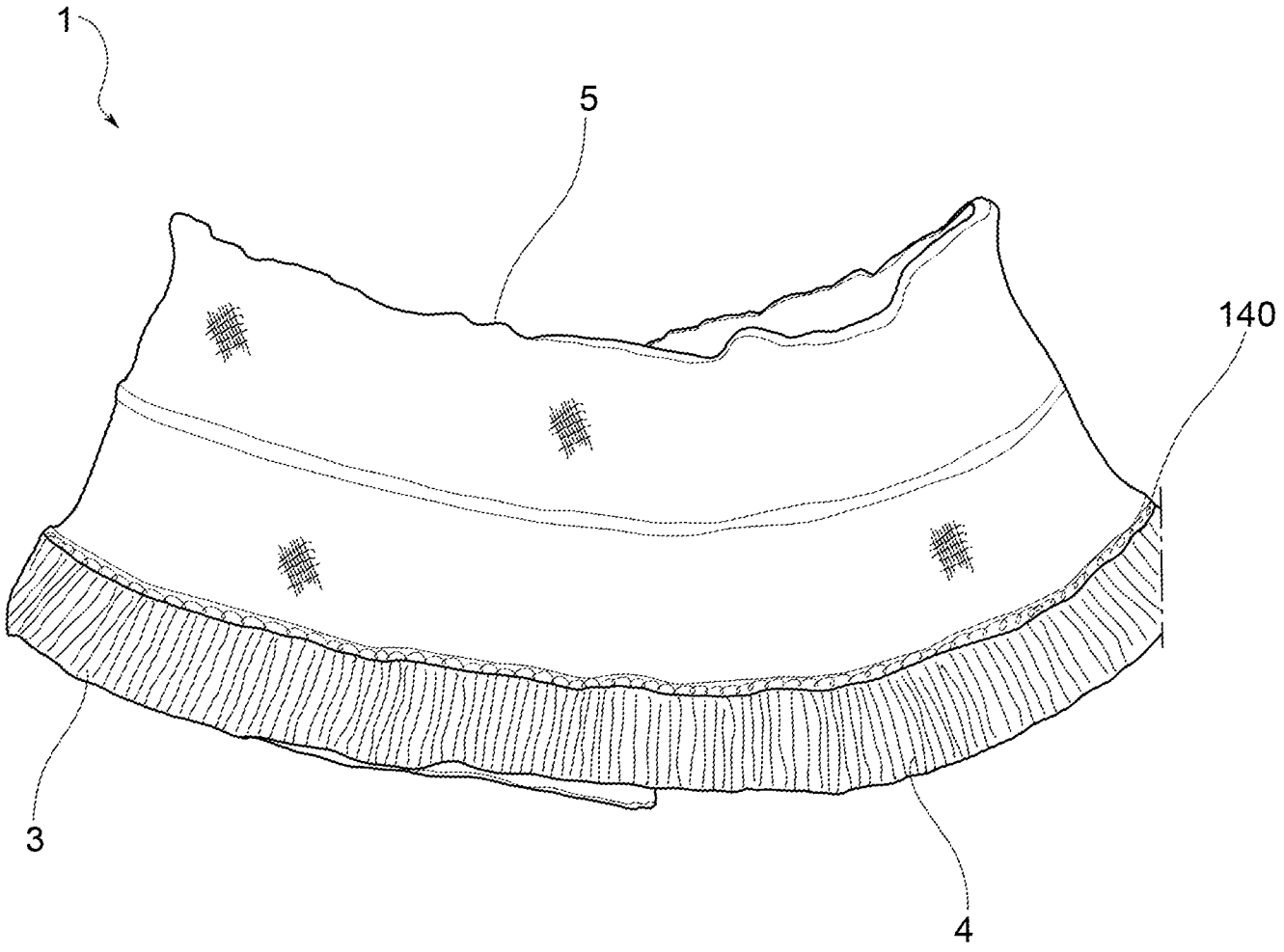
FIG. 3 shows a view of the neck to be folded and joined to the knitted fabric.
Figure 4:
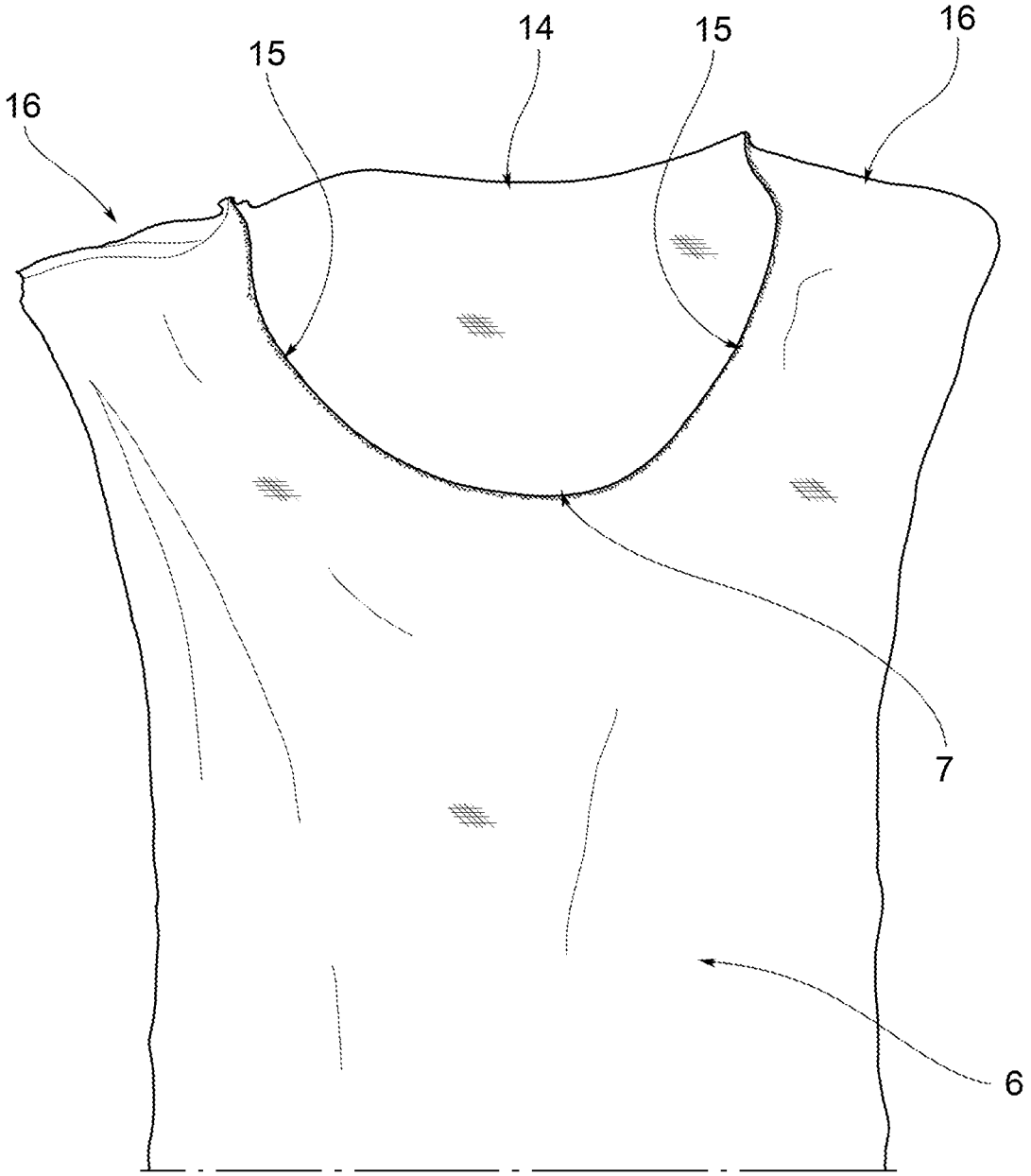
FIG. 4 shows a view of the knitted fabric to which the neck must be joined by linking.
Figure 5:
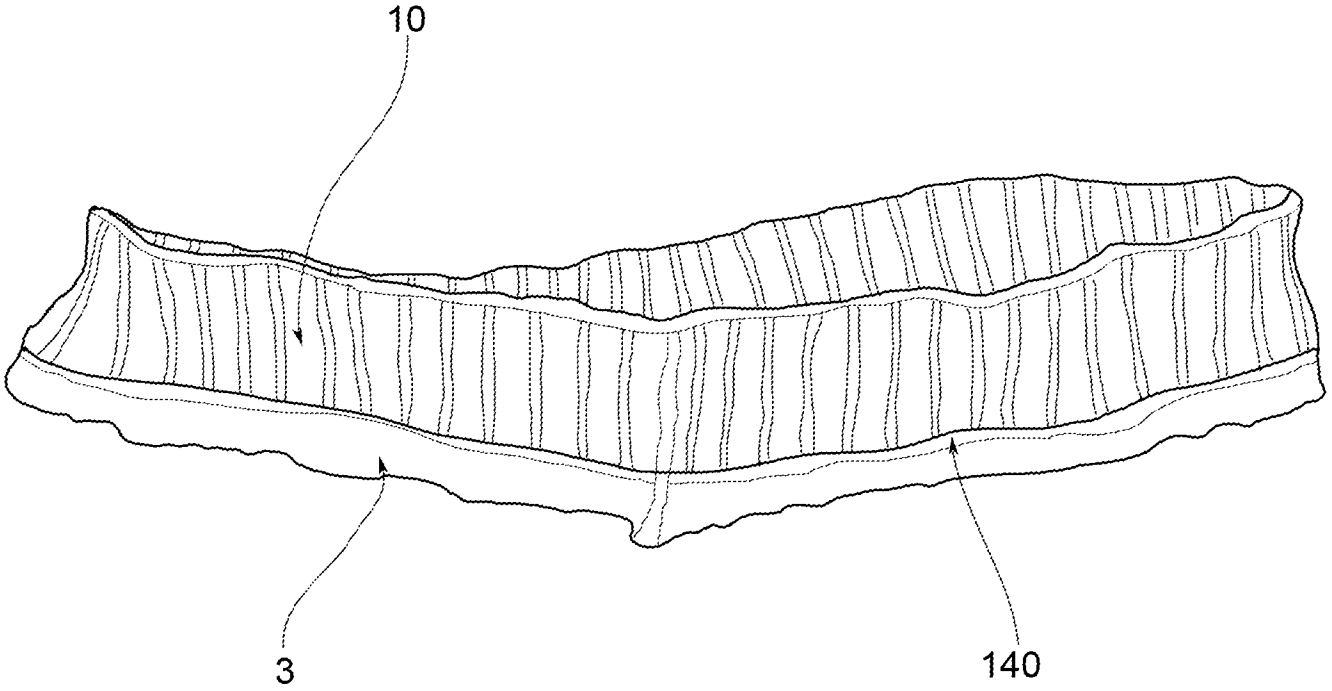
FIG. 5 shows a view of the standing neck to be joined to the knitted fabric.
Figure 6:
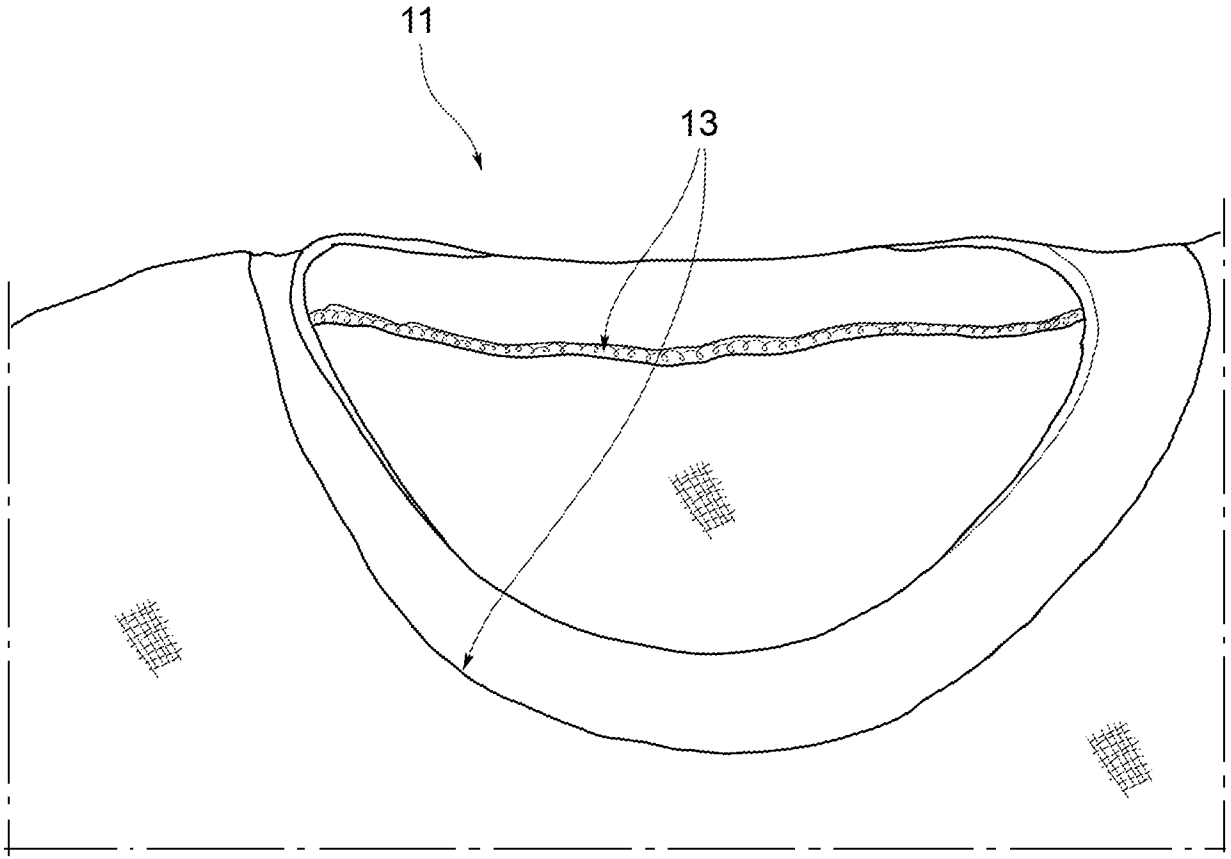
FIG. 6 shows a view of a sweater with the neck folded back after being joined together.
Figure 7:
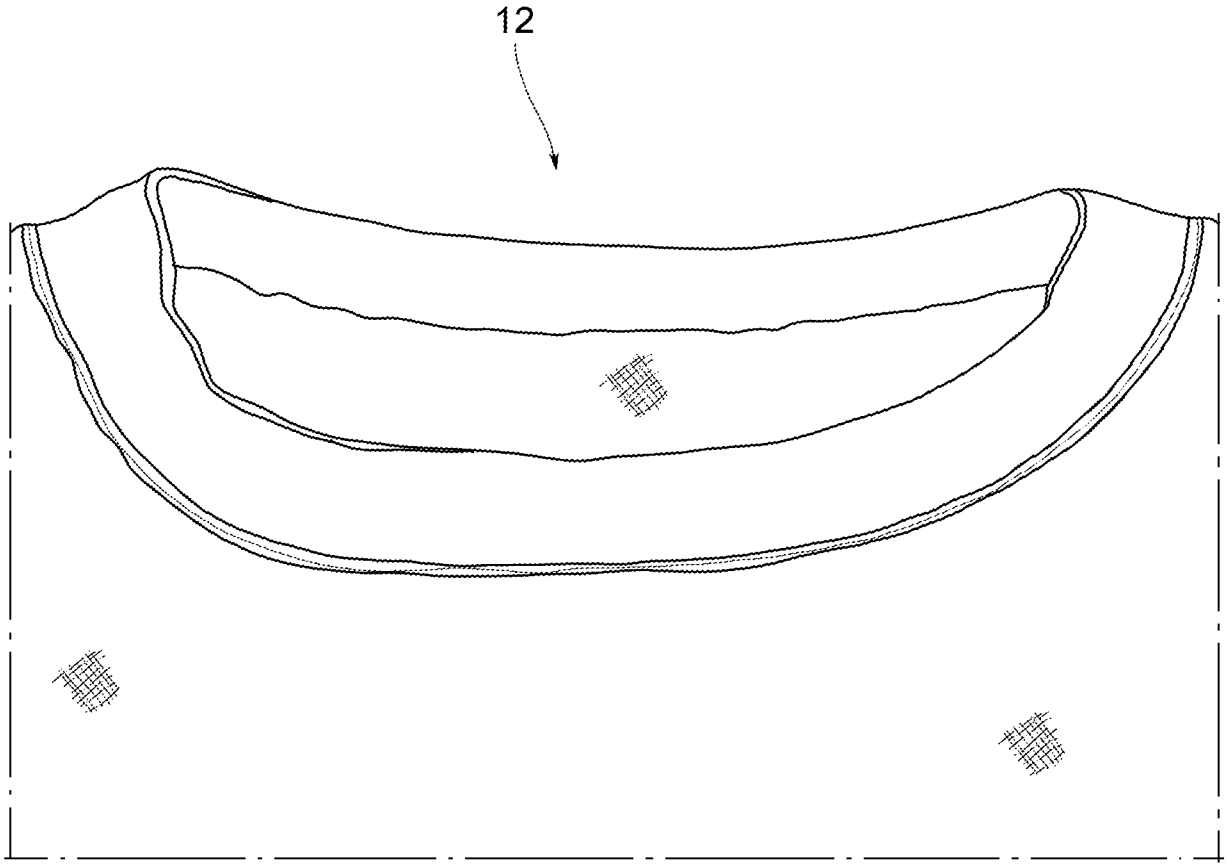
FIG. 7 shows a view of a sweater with the neck standing after being joined together.
Figure 8:
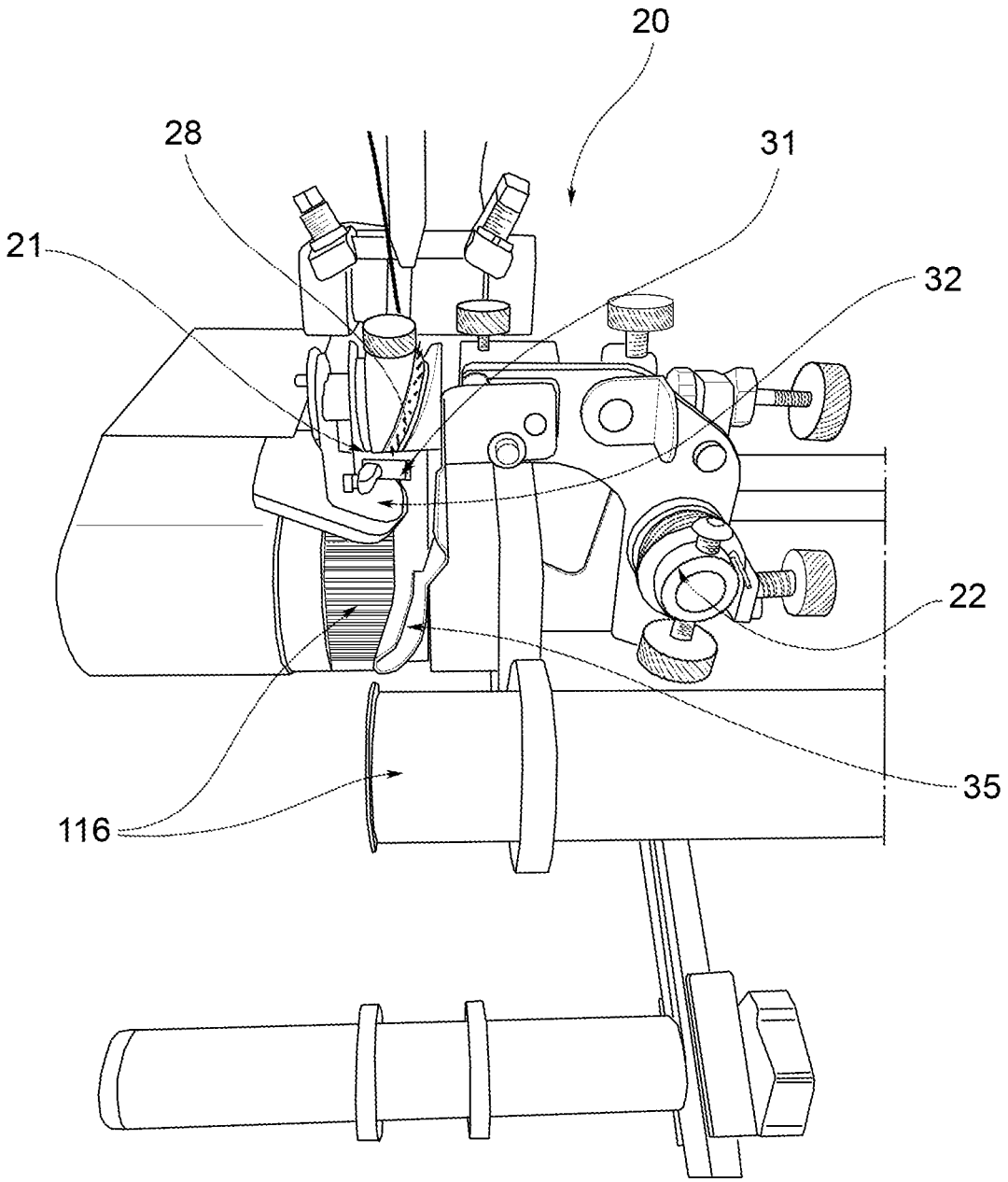
FIG. 8 shows a view of the feed guide installed on the linking machine.
Figure 9:
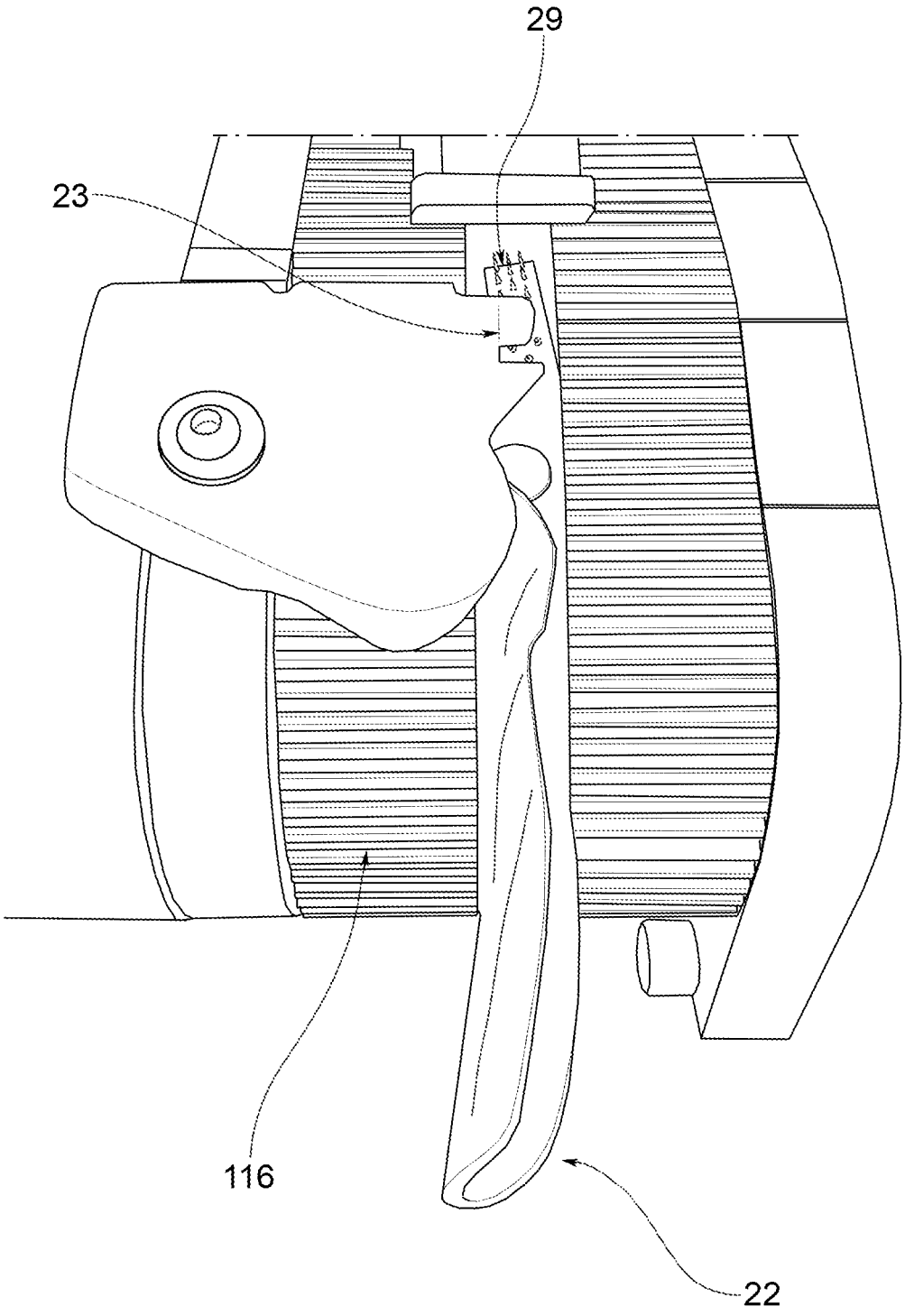
FIG. 9 shows a view of a part of the feed guide connected to the linking machine.

In the rest of the discussion, the joining of a neck 1, (FIGS. 3 and 5) and a knitted fabric 6 (FIG. 4), will be taken as an example.

For the linking operation between said two fabrics, for example the neck 1, 10 and the knitted fabric 6, the linking machine advantageously comprises a feed guide 20 for the neck 1, 10 and the knitted fabric 6, which aligns the fabrics at where one wants to sew the neck 1, 10 to the knitted fabric 6.

As seen, the guide 20 has the purpose of aligning two or more fabrics.

Figure 1B:
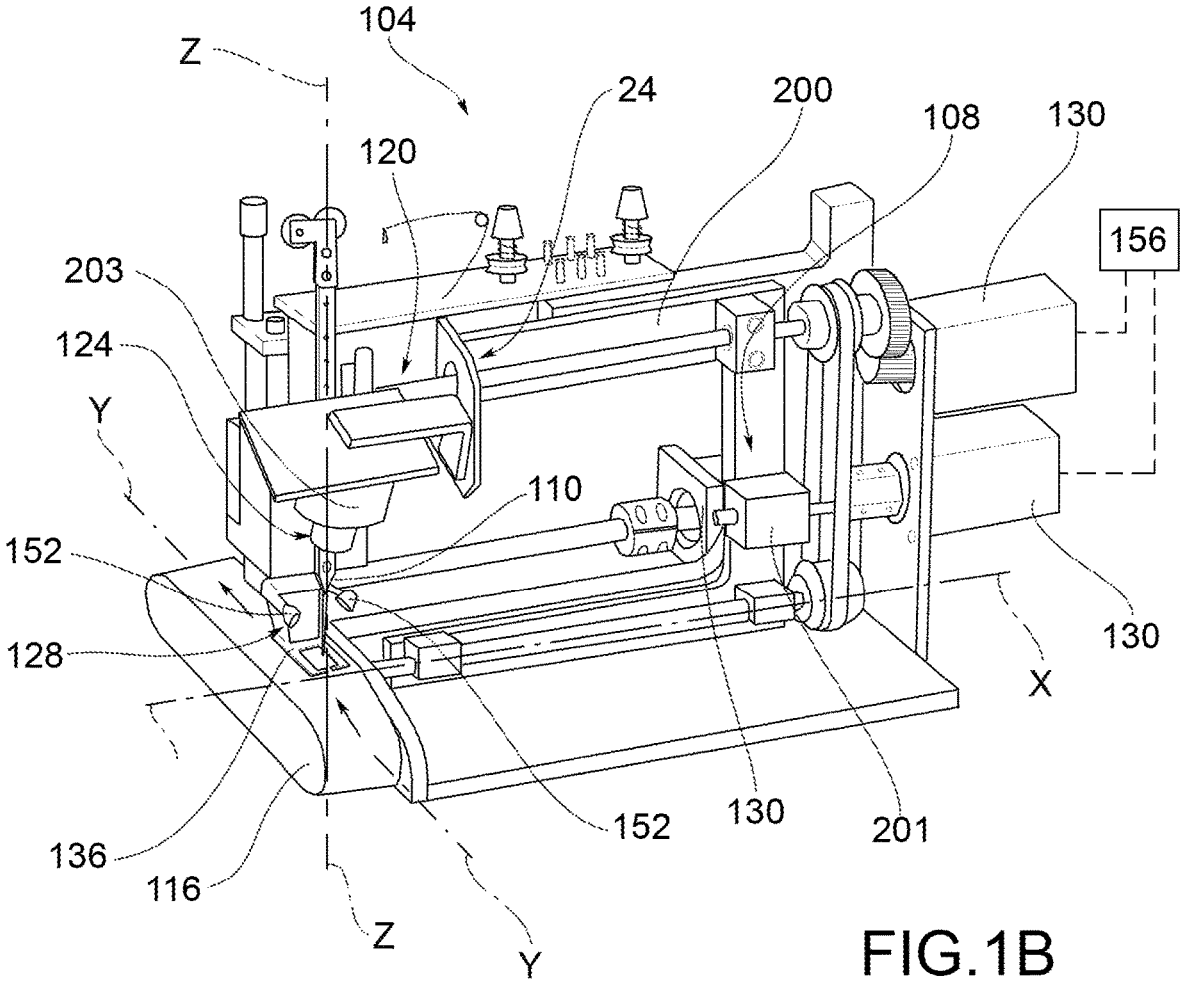

In the case of folded neck 1 and knitted fabric 6, it is desired to align the seam line 13 which will be made on the terminal row 4 of the neck 1 with the edge of the neckline 7 of the knitted fabric 6 so as to connect the folded neck 1 to the knitted fabric 6 satisfying the required quality criteria, i.e. maintaining a sewing line 13 identical to that obtained from a traditional linking machine (as shown in FIG. 1). In other words, measures (a) and (b) in FIG. 2 must be respected, as will be explained below. The guide 20, moreover, must be able to align the terminal row of the neck 4, on which the seam line 13 will be made, with the upper end of the neck 5, if the neck to be joined is a folded neck 1.

In the rest of the discussion, the joining of a folded neck 1, on the knitted fabric 6 will be taken as an example, since the joining of the standing neck, or not folded 10, is a simpler operation than the corresponding one on a folded neck 1.

In particular, the folded neck 1 is an edge of fabric closed in a loop comprising a waste part called "separating cotton" 3. Said separating cotton 3 is also provided in the case of a standing neck 10 which also has the configuration of an edge of fabric closed in a loop.

The knitted fabric 6 is initially devoid of the neck 1, 10.

The joining of the knitted fabric 6 and standing 10 or folded 1 neck forms the sweater which may be a sweater with folded neck 11 or a sweater with standing neck 12, respectively.

The neckline 7 of the knitted fabric 6, at the area where the neck 1, 10 is to be joined, presents different situations that are difficult to manage.

For example, along the neckline 7 the fabric has parts that are rolled towards the outside 14 of the knitted fabric 6 and sometimes towards the inside 15 of the knitted fabric 6. Furthermore, on the shoulders 16 of the knitted fabric 6, there are two stitches or joints which modify the thickness of the fabric, thus creating parts with variation of thickness 16. Basically, the edge of the neckline 7 of the knitted fabric 6, where the neck 1, 10 must be joined, is very irregular, as it has parts rolled outwards 14 and inwards 15 and parts with variations in thickness 16.

For these reasons, it is a difficult to manage fabric due to its correct alignment with the neck 1, 10.

Therefore, to manage the neckline 7 of the knitted fabric 6, where the neck 1 is joined, it is necessary to:

unroll the edge of the neckline 7 where it curls, bring the edge of the neckline 7 of the knitted fabric 6 to a precise point, so as to position the edge of the neckline in a predetermined and constant position despite its irregularity.

This is advantageously possible with the aid of a feed guide 20.

As seen, the fabrics are transported by a belt and roller drive system which constitutes the feed device 116; advantageously, the feed guide 20 is positioned at the beginning of said feed device 116.

The feed guide 20 comprises a pin 31 for opening the neck 1, 10 and allowing the insertion of the knitted fabric 6.

The feed guide 20 comprises a first stop 21 suitable to constitute an abutment and a positioning for the separating cotton 3 of the neck 1, 10.

Moreover, the feed guide 20 comprises a first toothed or needle dial 28 for pushing and holding the separating cotton 3 of the neck 1, 10 against said adjustable first stop 21. The first toothed or needle dial 28 peripherally comprises a plurality of teeth or needles for the purpose of engaging and dragging the fabric. Preferably, said first toothed or needle dial 28 is pivotable, i.e., it may be tilted or rotated about a rotation axis parallel to said vertical direction (Z-Z).

The feed guide 20 further comprises a bottom stop 22 configured to interface with a bottom edge 27 of the neck 1.

The feed guide 20 comprises shaped plates 33 for unrolling the neckline 7 of the knitted fabric 6. In particular, said shaped plates 33 interface with an unrolling system 32 of the neckline 7 of the knitted fabric 6.

The feed guide 20 is also provided with a system for adjusting 35 the pressure of the shaped plates 33.

Moreover, the feed guide 20 comprises an adjustable second stop 23 for varying the quantity (b), (see FIG. 2) of knitted fabric 6 sewn inside the folded neck 1.

Moreover, the feed guide 20 comprises a second toothed or needle dial 29 for holding and pushing in abutment the lower edge 27 of the folded neck 1 and for holding the knitted fabric 6 against said second adjustable stop 23. The second toothed or needle dial 29 peripherally comprises a plurality of teeth or needles for the purpose of engaging and dragging the fabric. Preferably, said second toothed or needle dial 29 is pivotable, i.e., it may be tilted or rotated about a rotation axis parallel to said vertical direction (Z-Z).

Figure 2:
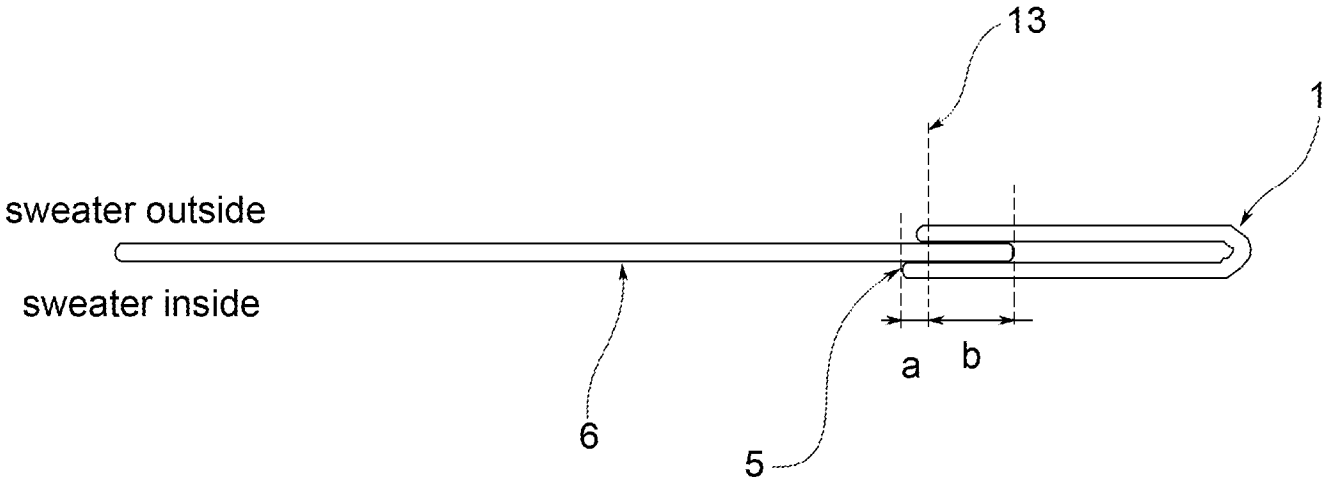
FIG. 2 shows an exemplary diagram of the junction of the knitted fabric and the folded neck to form the sweater.

Ideally, the alignment to be obtained between the knitted fabric 6 and the neck 1 may be explained and schematized in a simplified manner through FIG. 2, which illustrates the parameters or quantity (b) called "quantity of knitted fabric taken inside the neck", and the quantity (a) called "distance of the seam line 13 from the inner edge 5 of the neck 1", also called the upper end 5 of the neck 1.

The quantity of knitted fabric taken inside the neck "b" may be adjusted by means of the second stop 23 of the feed guide 20.

The quantity (a) called "distance of the seam line 13 from the inner edge 5 of the neck 1" is adjustable with the first stop 21 of the feed guide 20.

Therefore, the quantities (a) and (b) illustrated in FIG. 2 may be varied by means of the adjustable stops 21, 23 and according to the user's needs.

To describe the guide 20 and its fundamental elements that allow the management and correct alignment of the fabrics, we will describe the various steps for joining the folded neck 1 to the knitted fabric 6.

Figure 10:
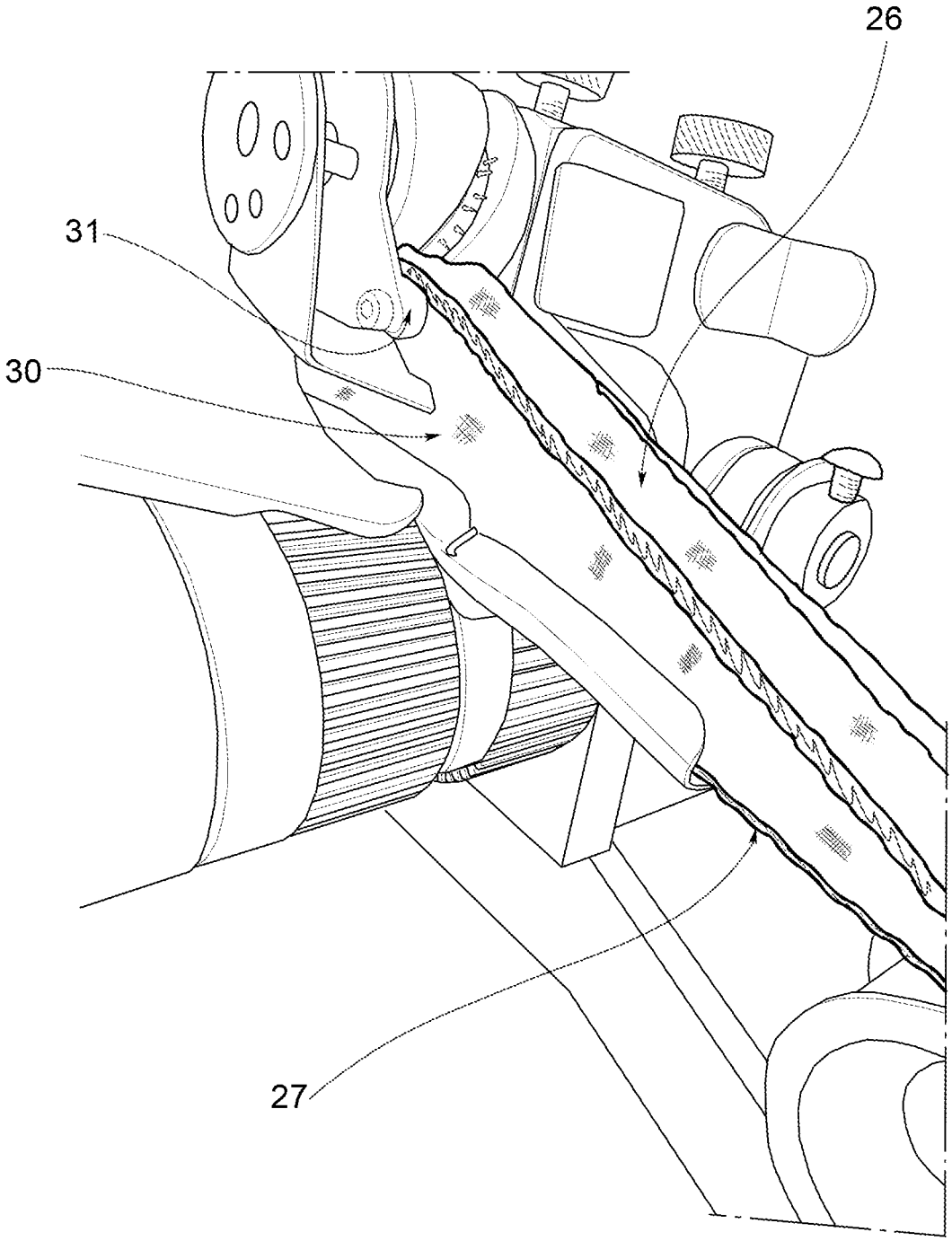
FIG. 10 shows a view of the guide with the folded neck assembled and ready for processing.
Figure 11:
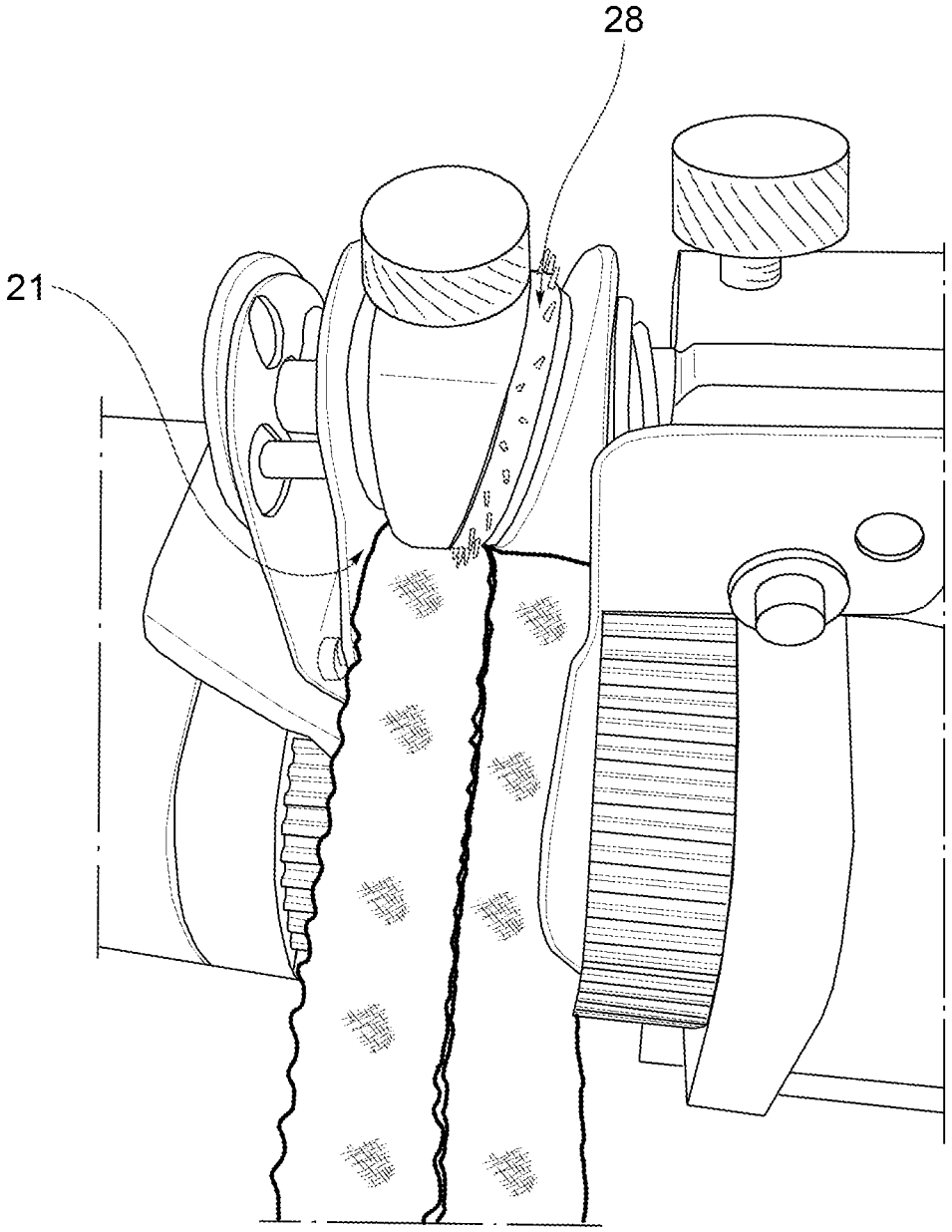
FIG. 11 shows a view of the guide with the detail of the position of the folded neck with respect to the guide.
Figure 12:
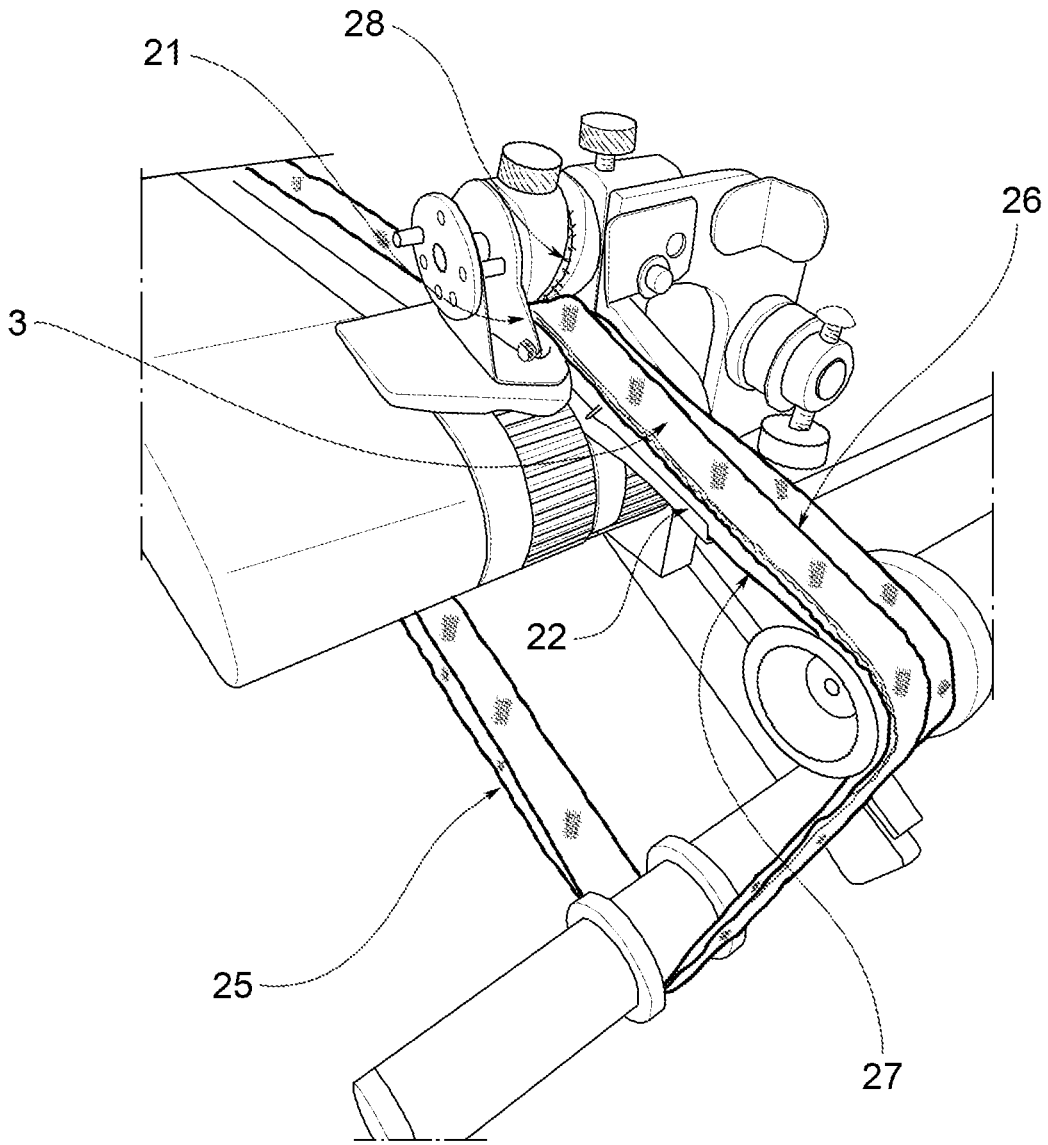
FIG. 12 shows a view of the folded neck mounted in the guide, open, to be able to insert the knitted fabric therein.

First of all, the neck 1 in the already folded configuration 25 is mounted in the linking machine 104 (FIG. 10), with the part of the separating cotton 3 facing upwards.

Thus, an upper or outer edge 26 and a bottom or inner edge 27 of the neck 1 are identified.

The neck 1 will be pulled by the transport system or feed device 116 and the feed guide 20 will take care of aligning the upper edge 26 and the bottom edge 27 of the neck 1 in a desired position, according to the required specifications, i.e. respecting the values "a" of distance of the seam line 13 from the inner edge 5 of neck 1 and "b" of quantity of knitted fabric taken inside the neck, schematized in FIG. 2.

Such alignment is done with two systems acting separately on the upper edge 26 and on the bottom edge 27 of the neck 1.

In particular, at the upper or outer edge 26, the separating cotton 3 is held in abutment against the adjustable first stop 21, by means of the first toothed or needle dial 28, oriented so as to push the separating cotton 3 against such horizontally adjustable first stop 21. The adjustment of the inclination of the first toothed or needle dial 28 modifies the force with which it pushes the separating cotton 3 against the first stop 21, irrespective of whether such first toothed or needle dial 28 is motorized or not. While varying the position of the first stop 21 horizontally, the alignment of the upper edge 26 of the neck 1 with respect to the bottom edge 27 changes horizontally, thereby varying the quantity (a), i.e. the distance of the seam line 13 from the inner edge 5 of the neck 1.

In the same way, the bottom edge 27, or neck edge which ends inside the knitted fabric 6, is held in abutment against the bottom stop 22 by the second toothed or needle dial 29. Said bottom stop 22 may be kept fixed while the inclination of the second toothed or needle dial 29 is, as seen, adjustable. By varying the inclination of the second toothed or needle dial 29, the thrust force of the second toothed or needle dial 29 towards the bottom edge of the neck 27 towards the bottom stop 22 changes.

With these two systems comprising adjustable stops 21, 22 and toothed or needle dials 28, 29, perfect alignment between the upper edge 26 and the bottom edge 27 of the neck 1 is obtained, so as to obtain a seam line having value (a), i.e. distance of the seam line 13 from the inner edge 5 of the neck 1, predetermined and constant along the entire seam line 13 itself.

During the alignment of the upper or outer edge 26 and the bottom or inner edge 27 of the neck 1, respecting the aforementioned distance (a), i.e. the distance of the seam line 13 from the inner edge 5 of the neck 1, it is necessary to insert the knitted fabric 6 unrolled, and positioned in the desired position with measure (b), i.e. quantity of knitted fabric 6 taken inside the neck 1, before proceeding with the final sewing or linking.

To do this, an opening 30 must be provided between the upper edge 26 and the bottom edge 27 of the folded neck 1.

Such opening 30 is made with said pin 31 of the feed guide 20 which holds the upper edge 26 of the neck 1 raised before coming into contact with the first needle dial 28.

Such first needle dial 28 has the dual task of preventing the upper edge 26 of the neck 1 from falling from the pin 31, and the task of pulling and holding the separating cotton 3 of the neck 1 against the first adjustable stop 21.

In this opening 30 between the upper edge 26 and the bottom edge 27 of the neck 1, the operator inserts the knitted fabric 6 with the aid of the feed guide 20.

For the management of the neckline 7 of the knitted fabric 6, as mentioned above, the unrolling system 32, comprising two shaped plates 33 with adjustable pressure between them, the second stop 23 adjustable horizontally, and the second toothed or needle dial 29 useful for pulling and holding the edge of the neckline 7 against the second stop 23, are provided.

Figure 13:
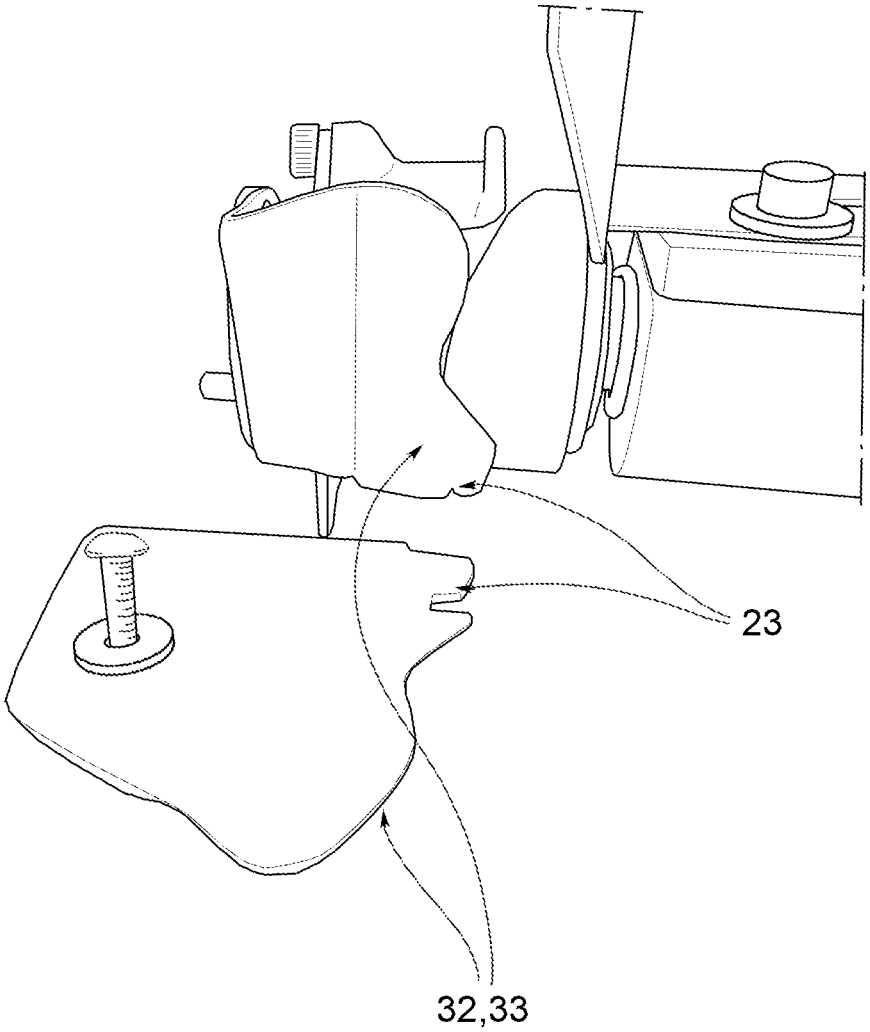
FIG. 13 shows a view of the plates for unrolling the fabric, which are a component of the guide.
Figure 14:
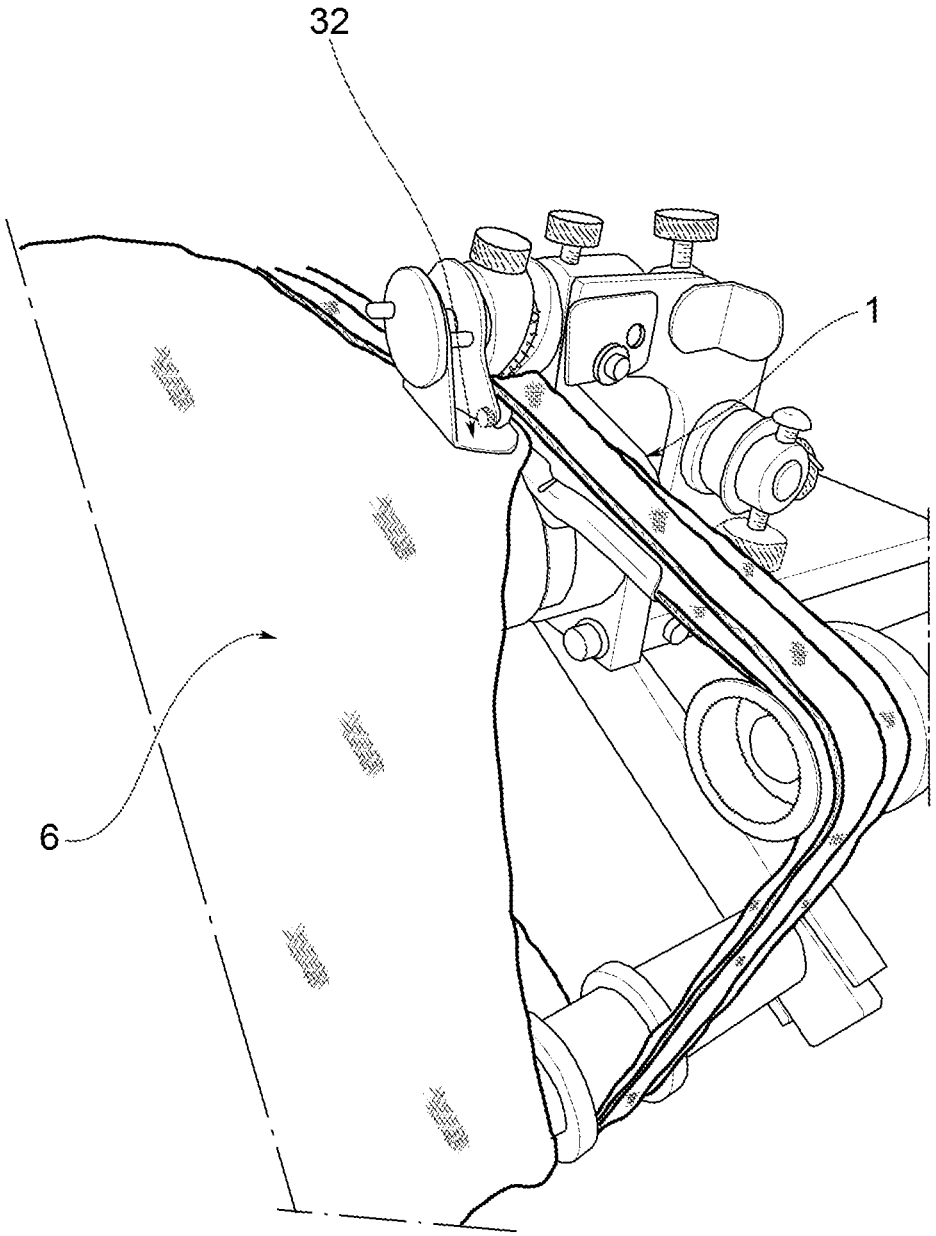
FIG. 14 shows a view of the guide with the neck and the knitted fabric assembled and ready for processing.
Figure 15:
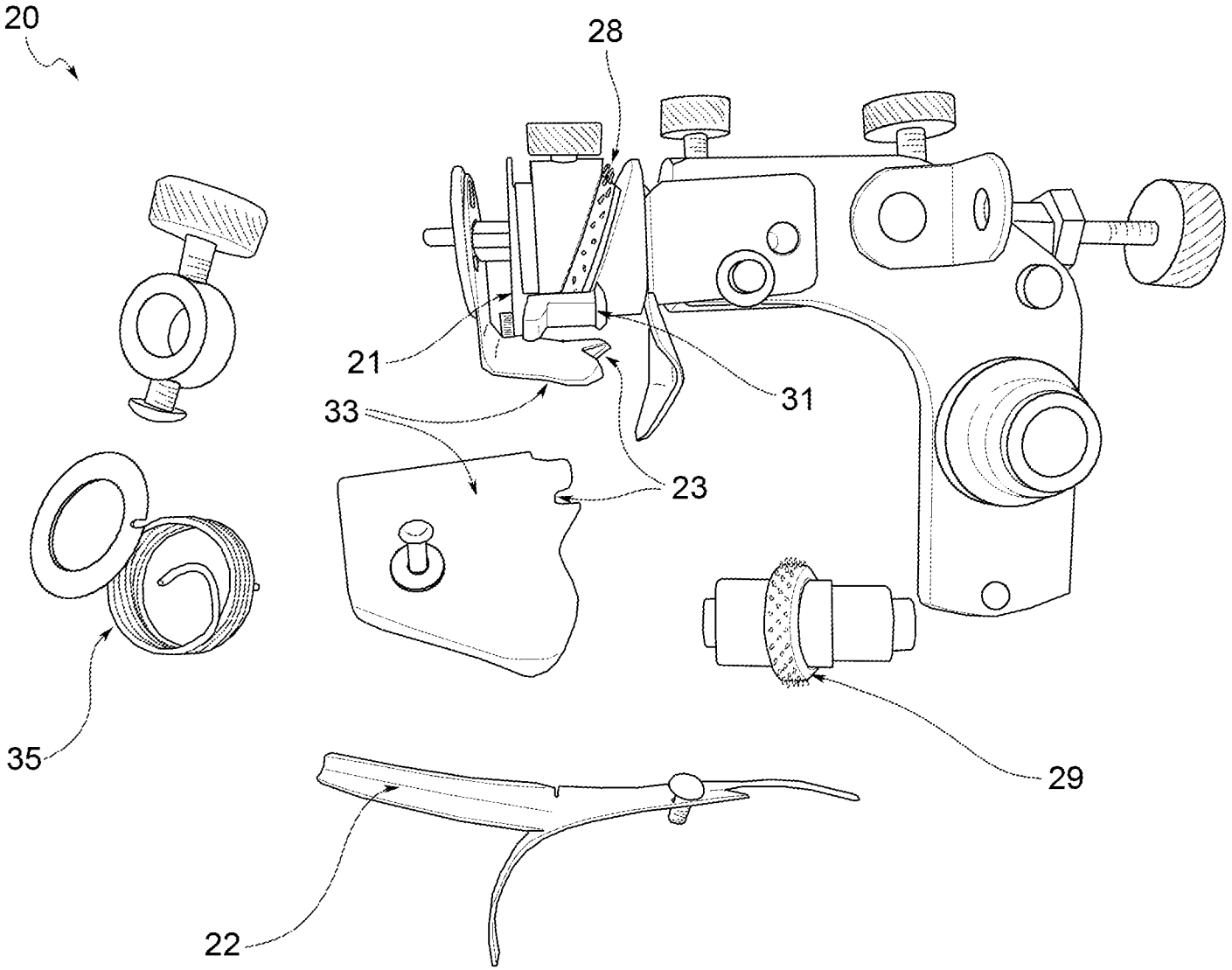
FIG. 15 shows a view of the guide components disassembled from the machine.

Once the knitted fabric 6 has been inserted (FIG. 14), the unrolling plates 33, suitably shaped (FIG. 13), unroll the edge of the neckline 7, irrespective of whether it is curled upwards or downwards.

The neckline 7 of the knitted fabric 6, after being unrolled, is held against the second stop 23 by the second needle dial 29.

Once the neck 7 of the knitted fabric 6 is unrolled and inserted, by the desired quantity (b) by means of the second stop 23, inside the folded neck 1, the opening 30 of the neck 1 must be closed and pressure maintained, between the upper edge 26 and the bottom edge 27 of the neck 1, to prevent the neckline 7 of the knitted fabric 6 from rolling up again or losing the position in which it was inserted in the neck 1.

The closing of the opening 30 of the neck 1 is done by the first needle dial 28: once the upper edge 26 of the neck 1 overcomes the pin 31, which serves to keep the upper edge 26 of the neck 1 raised, the first needle dial 28 pushes such upper edge 26 of the neck 1 downwards, keeping it against the first stop 21, to make it come into contact with the knitted fabric 6 which is clamped between the upper edge 26 and the lower edge 27 of the neck 1.

Immediately after the fabric, aligned as in FIG. 2 according to the predetermined values (a) and (b), enter under the fabric blocking means 128, and in particular under the foot 136 of the linking machine 104 to be sewn automatically.

As regards the joining of the standing neck 10 and the knitted fabric 6, the feed guide 20 remains the same, with the difference that the standing neck 10 must not be folded and it is as if only the upper edge 26 of the folded neck 1 remains. The bottom stop 22 for the bottom edge 27 of the neck 1 remains unused. The remainder of the feed guide 20 remains unchanged in operation. Therefore, the joining of the standing neck 10 and the knitted fabric 6 represents a simplification of the joining of the folded neck 1 and the knitted fabric 6 described above.

As may be appreciated from what is described, the present invention overcomes the drawbacks of the prior art.

In fact, the linking machine of the present invention is an automatic machine completely innovative in the way it operates with respect to a known manual linking machine.

In fact, by virtue of the presence of the feed guide upstream, the downstream linking machine will limit itself to identifying and performing, preferably with the aid of a camera, the stitching points on the folded or standing neck, to fix it to the pre-positioned knitted fabric by virtue of the help of the guide.

In other words, the present invention relates to a feed guide which, connected to the fabric feeding or advancement system (i.e. knitted fabric and folded or standing neck), helps the operator to present the fabrics correctly positioned to the machine and in particular to the camera mounted on the machine. In this way, the machine will be able to automatically proceed with the subsequent linking operation, i.e. reciprocal joining of said fabrics correctly positioned and presented to the linking needle.

The solution of the present invention allows the linking operation to be modernized, solving the limits of the current technology, increasing productivity, improving the quality of the processed fabrics, reducing the costs of processing and improving the working conditions of the workers involved in the linking.

In fact, the linking machine may be used by an untrained operator who simply has to position the fabric at the base of the needle and operate the linking machine with a command. The ease of use therefore makes the training time of personnel almost non-existent.

Furthermore, the linking machine of the present invention is flexible.

The processing speed is far higher than a manual linking machine; one may easily exceed a speed of 700 stitches per minute.

The linking operation is much less expensive and simpler to execute, at the same time increasing productivity and reducing processing times.

All the drawbacks related to the health of the operator due to the manual linking are solved.

Those skilled in the art may make several changes and adjustments to the linking machine and to the linking methods described above in order to meet specific and incidental needs, all falling within the scope of protection defined in the following claims.

The invention claimed is:

1. A linking machine comprising:

a fixed unit comprising a support frame, —and a mobile unit comprising:

a fabric feed device for advancing or transporting a fabric in a longitudinal direction—a device for positioning a needle in a transverse direction, perpendicular to said longitudinal direction and coplanar with the fabric, an actuator device of said needle in a vertical direction, perpendicular to said longitudinal and transverse directions, for performing the linking, wherein the linking machine comprises a feed guide for two fabrics to be joined, in particular a neck, provided with a separating cotton and a knitted fabric, positioned upstream of said needle in the longitudinal direction, the feed guide comprising—a first stop suitable to constitute an abutment and a positioning for said separating cotton of the neck, said first stop being adjustable in position along said transversal direction so as to be able to adjust a distance of a seam line from the inner edge of the neck, wherein the feed guide comprises a first toothed or needle dial for pushing and holding the separating cotton of the neck against said adjustable first stop, wherein the feed guide comprises a second toothed or needle dial for holding and pushing in abutment the lower edge of the folded neck and for holding the knitted fabric against said second adjustable stop.

2. The linking machine according to claim 1, wherein the first toothed or needle dial peripherally comprises a plurality of teeth or needles for the purpose of engaging and dragging the fabric.

3. The linking machine according to claim 1, wherein said first toothed or needle dial can be tilted or rotated about a rotation axis parallel to said vertical direction.

4. The linking machine according to claim 1, wherein the feed guide comprises a bottom stop configured to interface with a bottom edge of the neck, and adjustable to vary said distance of the seam line from the inner edge of the neck.

5. The linking machine according to claim 1, wherein the feed guide comprises an adjustable second stop configured to receive in abutment a neckline of the knitted fabric and adjustable to vary the amount of knitted fabric sewn inside a folded neck.

6. The linking machine according to claim 1, wherein the second toothed or needle dial peripherally comprises a plurality of teeth or needles for the purpose of engaging and dragging the fabric.

7. The linking machine according to claim 1, wherein said second toothed or needle dial is pivotable, i.e., it can be tilted or rotated about a rotation axis parallel to said vertical direction.

8. The linking machine according to claim 1, wherein the feed guide comprises shaped plates (33) for unrolling the neckline of the knitted fabric.

9. The linking machine according to claim 8, wherein said shaped plates have an attachment edge having an undulated pattern.

10. The linking machine according to claim 9, wherein said undulated pattern is of the sinusoidal type.

11. The linking machine according to claim 8, wherein the feed guide is provided with a system for adjusting the pressure of the shaped plates.

12. The linking machine according to claim 1, wherein said feed guide comprises a pin, for opening the neck and allowing insertion of the knitted fabric.

13. The linking machine according to claim 1, wherein the machine comprises a camera suitable to detect a guide thread placed at the at least one fabric to be joined, said guide thread being inserted inside the fabric so as to identify a plurality of segments, the machine comprises a control unit, operatively connected to the camera and to actuators of the fabric feed device, the positioning device of the needle and the drive device of the needle, so as to determine in real-time the target sewing position of the needle as a function of the guide thread and to control in real-time the fabric feed devices, needle-positioning devices and drive devices of the needle to reach said target sewing position of the needle.

* * * * *